US006020685A

United States Patent [19]

Wei et al.

[11] Patent Number: 6,020,685

[45] Date of Patent: Feb. 1, 2000

[54] LAMP WITH RADIALLY GRADED CERMET FEEDTHROUGH ASSEMBLY

[75] Inventors: George C. Wei, Weston, Mass.; Stefan Juengst, Zorneding, Germany

[73] Assignee: Osram Sylvania Inc., Danvers, Mass.

[21] Appl. No.: 08/883,852

[22] Filed: Jun. 27, 1997

[51] Int. Cl.[7] ..... H01J 5/24; H01J 5/26

[52] U.S. Cl. ..... 313/625; 313/623

[58] Field of Search ..... 313/623, 624, 313/625, 332, 25, 636, 634; 445/26, 43

[56] References Cited

U.S. PATENT DOCUMENTS

| | | | |
|---|---|---|---|
| 3,742,283 | 6/1973 | Loughridge | 313/318 |
| 4,155,758 | 5/1979 | Evans et al. | 75/232 |
| 4,354,964 | 10/1982 | Hing et al. | 252/518 |
| 4,602,956 | 7/1986 | Partlow et al. | 75/235 |
| 4,687,969 | 8/1987 | Kajihara et al. | 313/625 |
| 4,731,561 | 3/1988 | Izumiya et al. | 313/624 |
| 4,825,126 | 4/1989 | Izumiya et al. . | |
| 5,075,587 | 12/1991 | Pabst et al. | 313/25 |
| 5,404,078 | 4/1995 | Bunk et al. | 313/625 |
| 5,484,315 | 1/1996 | Juengst et al. | 445/26 |
| 5,742,123 | 4/1998 | Nagayama | 313/623 |

FOREIGN PATENT DOCUMENTS

| | | | |
|---|---|---|---|
| 0178700 | 4/1986 | European Pat. Off. | H01K 1/38 |
| 0528428 | 2/1993 | European Pat. Off. | H01J 61/36 |
| 0609477 | 2/1993 | European Pat. Off. | H01J 61/36 |
| 0650184 | 7/1993 | European Pat. Off. | H01J 61/36 |
| 0650184 | 1/1994 | European Pat. Off. | H01J 61/36 |
| 0597679 | 5/1994 | European Pat. Off. . | |
| 2032277 | 12/1971 | Germany | H01J 61/36 |
| 4530431 | 10/1970 | Japan . | |
| 2205859 | 12/1980 | United Kingdom | B32B 33/00 |

OTHER PUBLICATIONS

Characterization and Properties of Chemically Processed Nanophase Wc–Co Composites; L. McCandish et al. High Performance Composites For the 1990's; The Minerals, Metals and Materials Society, pp. 227–237, 1991 (no month).

Thermomechanical Properties of SiC–Aln/Mo Functionally Gradient Material; M. Tanaka et al. pp. 309–313 "Japan Powders and Powder Metallurgy" vol. 39, No. 4, Apr. 1992.

Recent Development of Functionally Gradient Materials For Special applications to Space Plane, R. Watanabe et al. Composite Materials pp. 197–208, 1992 (no month).

The Relationship Between Physical Properties and Microstructures of Dense Sintered Cermet Materials; P. Hing: Science of Ceramics V9 pp. 135–142, Dec. 1977.

*Primary Examiner*—Michael H. Day
*Attorney, Agent, or Firm*—William H. McNeill

[57] ABSTRACT

This invention involves a new type of feedthrough-plug member for metal halide HID lamp using PCA envelopes. The construction of the lamp housing consists of a PCA envelope and specially designed radially graded alumina-metal cermet multi-layers to eliminate cracking in cermet or PCA due to thermal stresses arising from thermal expansion mismatch. The fills are metal halides such as Na-Sc-I, rare earth halides, Hg, Sn, and inert gases. The PCA vessel and directly sealed cermetfeedthrough assemblies allow the metal halide lamps to operate at high wall temperatures with better lumen output, color temperature, and CRI.

17 Claims, 7 Drawing Sheets

LAMP WITH RADIALLY GRADED CERMET FEEDTHROUGH ASSEMBLY

FIELD OF THE INVENTION

The present invention relates to a ceramic envelope device, to a lamp with such a device, and more preferably to a metal halide lamp with a polycrystalline alumina (PCA) envelope whose ends are closed by ceramic-like plugs. More particularly, it is directed to a device with at least one cermet plug having parts or zones or layers with gradually changing coefficients of thermal expansion. Moreover it relates to such cermet plugs themselves and the method for making the same.

BACKGROUND

Metal halide high intensity discharge (HID) lamps are desired to run at high wall temperatures in order to improve the efficacy, alter the color temperature, and/or raise the color rendering index of the light source. Typically, the metal halide lamps include fills comprising halides (especially iodides and bromides) of one or more metals, such as Na. Often Na is used in combination with Sc or Sn. Further additions are Th, Tl, In and Li. Other types of filling include rare earth metals such as Tm, Ho and Dy. Lamps which contain such fills have very desirable spectral properties: efficacies above 100 lm/W, color temperatures of about 3700 K, and color rendering indices (CRI) around 85. Because of the low vapor pressure of some of the metal halide additives, the fused quartz lamp envelope must be operated at higher than normal temperatures. At wall temperatures exceeding 900–1000° C., the lifetime of the lamps is limited by the interaction between the metal halides and the wall made from quartz glass. The use of arc tube materials which can be operated at higher temperatures than quartz glass and which are chemically more resistant than quartz glass provides an effective way to increase the lifetime of lamps containing these metal halides.

Polycrystalline alumina (PCA) is a sodium resistant envelope for high pressure sodium lamps. PCA can operate at higher temperatures than quartz glass and it is expected to be chemically more resistant than quartz glass. The PCA vessel is closed at its ends by means of alumina plugs. Gastight sealing is achieved by sealing glass, often referred to as fusible ceramic or frit. However, investigations of metal halide chemistries in PCA envelopes have shown that reactions between the metal halides and conventional frits or even allegedly "halide-resistant" frits severely limit lifetime. An example of such a frit is based on the components CaO, $Al_2O_3$, BaO, MgO and $B_2O_3$. Consequently, it is highly desirable to find a fritless seal method.

Normally, PCA lamps use feedthroughs made from niobium because their coefficients of thermal expansion are similar. Especially when the fill contains rare earth halides, one problem is involved by the reactions between the Nb feedthroughs and the fill. This problem was alleviated somewhat by using special arrangements wherein the plug and the feedthrough is simultaneously replaced by a plug made from electrically conductive cermets. These cermets are composite sintered bodies usually comprising alumina (the arc tube material) and Mo or W (a conductive halide resistant material).

U.S. Pat. No. 4,354,964, Hing et al., discloses an electrically-conducting alumina-metal (e.g. tungsten or molybdenum) cermet containing 4 to 20 vol. % metal for use as plug members or feedthroughs in PCA (polycrystalline alumina) envelopes of metal halide HID (high-intensity discharge) lamps. The cermet has refractory metal rods (as electrodes or current leads). They are embedded in the cermet body in the green or prefired state and then co-fired during final sintering of the cermet to high density. The method of joining such cermets with PCA tubes is not described. Thermal expansion mismatch between the cermet and PCA, or between the cermet and tungsten or molybdenum electrode can not be eliminated simultaneously. Such differential thermal expansion can result in cracking and leaks in either PCA tubes or cermet, or in both, during lamp on-and-off operation.

U.S. Pat. No. 4,731,561, Izumiya et al., showed one end of the PCA tube was enclosed with a co-sintered electrically-conductive alumina-Mo or W cermet. The other end of the PCA tube was enclosed with a frit-sealed cermet. The cermets were all coated with an insulating layer so as to prevent back-arcing.

U.S. Pat. No. 4,687,969, Kajihara et al, describes besides conducting cermet plugs also non-conducting cermets with feedthroughs passing through and projecting in- and outwardly. One end of the PCA tube has a co-sintered cermet, while the other end has a frit-sealed cermet. However, cracking in the cermet can not be prevented, since the composition of the plug is fixed and is not direction dependent.

All these one-part plugs have the disadvantage that their coefficient of thermal expansion doesn't really fit the surrounding part (e.g. vessel). A solution is suggested for example in U.S. Pat. No. 4,602,956, Partlow et al. It discloses a cermet plug that comprises a core, consisting essentially of 10 to 30 volume percent W or Mo, remainder alumina, and one or more layers of other cermet compositions surrounding the core and being substantially coaxially therewith. The layers consist essentially of from about 5 to 10 volume percent W or Mo, the remainder alumina. Such a cermet plug is hermetically sealed to the end wall of the arc tube by means of "halideresistant" frits.

However, such an electrically conductive cermet plug is not sufficiently gastight over a long period of time.

Another solution is a non-conductive cermet plug having a more dense structure. However, a separate metal feedthrough is needed. U.S. Pat. No. 5,404,078, Bunk et al., discloses a high pressure discharge lamp with a ceramic vessel whose ends are closed by non-conductive cermet plugs consisting for example of alumina and tungsten or molybdenum. In a specific embodiment (FIG. 9) the cermet plug consists of concentric parts with different proportions of tungsten. These parts provide gradually changing coefficients of thermal expansion.

European Patent Application No. 650 184, Nagayama, discusses an arc tube with end plugs consisting of a non-conducting cermet whose features resemble those disclosed in the embodiments of FIG. 1 and 9 of U.S. Pat. No. 5,404,078, Bunk et al. The disc-like plug is made of concentric rings or layers of different composition (radially graded seal). Moreover, in other embodiments (FIG. 16 ff.) the cermet plug is made from axially aligned layers of different composition (axially graded seal). There is a direct sinter connection between the vessel and the neighboring first layer of the plug.

U.S. Pat. No. 4,155,758, Evans et al., discloses in FIG. 14 an axially graded plug, too. However, it is made from three layers of electrically conducting cermet.

DISCLOSURE OF THE INVENTION

It is an object of the invention to provide a ceramic envelope device for a high pressure discharge lamp, especially for a metal halide lamp with a very long lasting gastight seal. A further object is to provide a lamp made from such a device. A further object is to provide a method of manufacture for such a device.

Briefly, this object is achieved by a device with the following features:

- a translucent ceramic tube having a first end and a second end, the tube confining a discharge volume;
- a first electrically non-conducting cermet end plug, said first plug closing said first end of the ceramic tube;
- a second electrically non-conducting cermet end plug, said second plug closing said second end of the ceramic tube;
- said plugs having a multipart structure with at least three parts;
- a first and second metal feedthrough passing through the first and second plug respectively, each feedthrough having an inner and outer end, respectively, said feedthroughs being made from one of the group of the metals tungsten, molybdenum and rhenium;
- electrodes located at the inner end of the first and second feedthrough respectively
- the coefficients of thermal expansion of at least one part of the plugs being between those of the arc tube and the feedthrough;
- wherein said plugs comprise at least five parts with different coefficients of thermal expansion;
- the difference between the coefficients of thermal expansion for adjacent parts including the tube and the feedthroughs being less than $1.0\times10^{-6}$/K;
- the plug is directly sintered both to the arc tube and the feedthrough.

These features work together as follows: The graded cermet comprises parts or zones with slightly different coefficients of thermal expansion. The coefficients decrease from the outermost part of the plug (related to the distance from the axis) to the innermost part of the plug. Outermost part means the part that is radially most distant from the axis of the device. Innermost part means the part that is radially closest to the axis.

The outermost zone including the outer surface of the plug matches good with that of the alumina arc tube, whereas the thermal expansion behavior of the innermost zone including the inner surface of the plug matches good to the feedthrough. The intermediate parts serve as transition zones which gradually bridge the difference in the coefficients of thermal expansion of the inner and outer zone or part.

The different features of the different zones can be achieved by mixing different amounts of metal powder (tungsten or molybdenum) to the alumina powder at the beginning of the cermet preparation. Surprisingly, a plug comprising tungsten in combination with a molybdenum feedthrough is most promising.

There are several possibilities to provide the parts of said plug with different coefficients of thermal expansion. One way is that the composition of the different parts comprises alumina as a first component and a metal, preferably tungsten or molybdenum, as a second component. The compositions of the parts differ in the proportion of the metal added to alumina.

Another way of achieving this aim is, that the composition of the different parts uses different constituents, for example aluminum nitride and aluminum oxynitride. Whereas the coefficient of thermal expansion of aluminum nitride has a given value (see for example U.S. Pat. No. 5,075,587), the coefficient of aluminum oxynitride depends on the proportions between its constituents, namely alumina and aluminum nitride. The situation is similar to a cermet made from the constituents alumina and one of the metals tungsten or molybdenum.

In a preferred embodiment, the plug is formed like a disc and made from concentric parts with radially graded coefficients of thermal expansion.

In an especially preferred configuration which is easy to manufacture, the disc-like plug is made from a spirally wound band with zones of stepwise or smoothly increasing coefficients of thermal expansion. The length of the zones is adapted to the circumference of quasi concentric parts which is radially dependent and increasing outwardly.

Instead of stepwise changing features it is also possible that the coefficient of thermal expansion changes smoothly. Another imagination of this embodiment is that the number of parts is infinite.

In an especially preferred embodiment the plug is a layered cylindrically shaped structure with a central bore. Only the innermost layer adjacent the feedthrough is in gas-tight contact with the feedthrough. The outermost layer is in contact with the vessel.

In order to avoid capillary effects in this embodiment it is advantageous that the distance between the feedthroughs and the layers of the plug (except the innermost layer which is in contact with the feedthrough) is at least 1 mm. This distance may be the same for all layers.

Of special importance is the distance between the outermost layer of the plug and the feedthrough. It is preferably at least 3 mm.

An advantageous structure is a telescope-like plug, wherein the distance between the layers and the feedthroughs decreases stepwise from the outermost to the innermost layer.

The advantage of the concept of an axially graded seal is that the temperature load of the seal is minimized and gas-tightness is optimized, when only one layer, namely the outermost layer, is at least partially located in the end of the arc tube. This means that the outermost layer either is fully enclosed in the end of the arc tube or is only partially enclosed in it.

The inventive cermet consists of an alumina matrix wherein tungsten particles are embedded. These particles are at least approximately ball-shaped. It turned out that the different thermal expansion behavior of the alumina matrix and the tungsten partides is a critical feature.

The average thermal expansion of alumina-tungsten cermet as a function of the amount of tungsten is known, see for example "The Relationship between Physical Properties and Microstructures of Dense Sintered Cermet Materials", P. Hing, pp. 135–142, Science of Ceramics. ed. K. J. de Vries, Vol. 9, Nederlandse Keramische Verenigung (1977). Accordingly the proportion of tungsten required for a given thermal expansion can be determined.

It turned out that microscopic stresses developed in the alumina matrix at the interface to the tungsten particles. The stresses decrease with decreasing size of the minority partner. The minority partner is often referred to as dispersoid or dispersed phase. For some zones, this minority partner is alumina, for other zones the metal (here: tungsten).

Therefore, a very fine particle size for the tungsten powder is preferred for aluminatungsten cermet containing <50 vol.-% of W. In practice, tungsten precursors such as ammonium tungstate that is soluble in water can be used to produce very fine particles of tungsten in a matrix of alumina. Tungsten precursors can be dissolved in water, mixed with alumina powder, and calcined to convert to fine tungsten particles. A similar technique was used in making a nanophase WC-Co composite powder, see "Characterization and Properties of Chemically Processed Nanophase WC-Co Composites", L. E. Mc Candlish, B. K. Kim, and B. H. Kear, p. 227–237, in: High Performance Composites for the 1990s; ed.: S. Das, C. Ballard, and F. Marikar, TMS, Warrendale, Pa., 1991.

Conversely, for alumina-W cermet containing <50 vol.-% alumina, precursors of alumina (soluble in water) such as aluminum nitrate can be used to result in very fine alumina particle size.

It is important to select the appropriate starting materials for the manufacture of the cermet to achieve:

(1) a uniform distribution of the dispersed phase;

(2) a fine particle size of the dispersed phase;

(3) a green density and firing shrinkage compatible with the neighboring layers, in order to produce graded cermets free of cracks or distortion,;

(4) a green density and firing shrinkage behavior so as to form a direct bond between metal feedthrough and cermet plug, and between cermet plug and PCA arc tube, respectively.

Typical ranges for the dimensions of such cermet plugs are:

outside diameter 3.0 to 4.0 mm;

length over all in case of axially graded plugs 8.0 to 15.0 mm;

length over all in case of radially graded plugs 4.0 to 7.0 mm.

For axially graded cermets, the gap between the plug parts and the feedthroughs is preferably less than 0.1 mm. The radial thickness of the outermost zone as well as of the innermost zone is preferably between 3.0 and 5.0 mm. The radial thicknesses of the intermediate zones is preferably between 1.0 and 2.0 mm.

For radially graded cermets, the radial thickness of the zones is preferably less than 1.0 mm. In case of the tape technique it is preferably 0.2 to 0.4 mm. Naturally the lengths of zones on the tape is non-equal. For example, the length of the zones intended to act as inner intermediate parts or even as innermost part (these parts having a high tungsten proportion) is between 2.5 and 5.0 mm. The length increases stepwise, preferably to 9.0 to 13.0 mm. This is related to the increasing circumference during winding of the tape. The overall length of such a tape is in the order 50 mm or more. The width of the tape (corresponding to the height of the plug) is typically 4 to 6 mm.

The feedthroughs may be tubular or pin-like. Preferably they are tubes having dimensions of the following typical ranges:

outer diameter between 0.9 and 1.6 mm;

inner diameter between 0.6 and 1.2 mm;

over all length between 10 and 15 mm.

The invention is further illuminated by way of examples.

BEST MODE FOR CARRYING OUT THE INVENTION

For a better understanding of the present invention, together with other and further objects, advantages and capabilities thereof, reference is made to the following disclosure and appended claims taken in conjunction with the above-descibed drawings.

Figure 1:
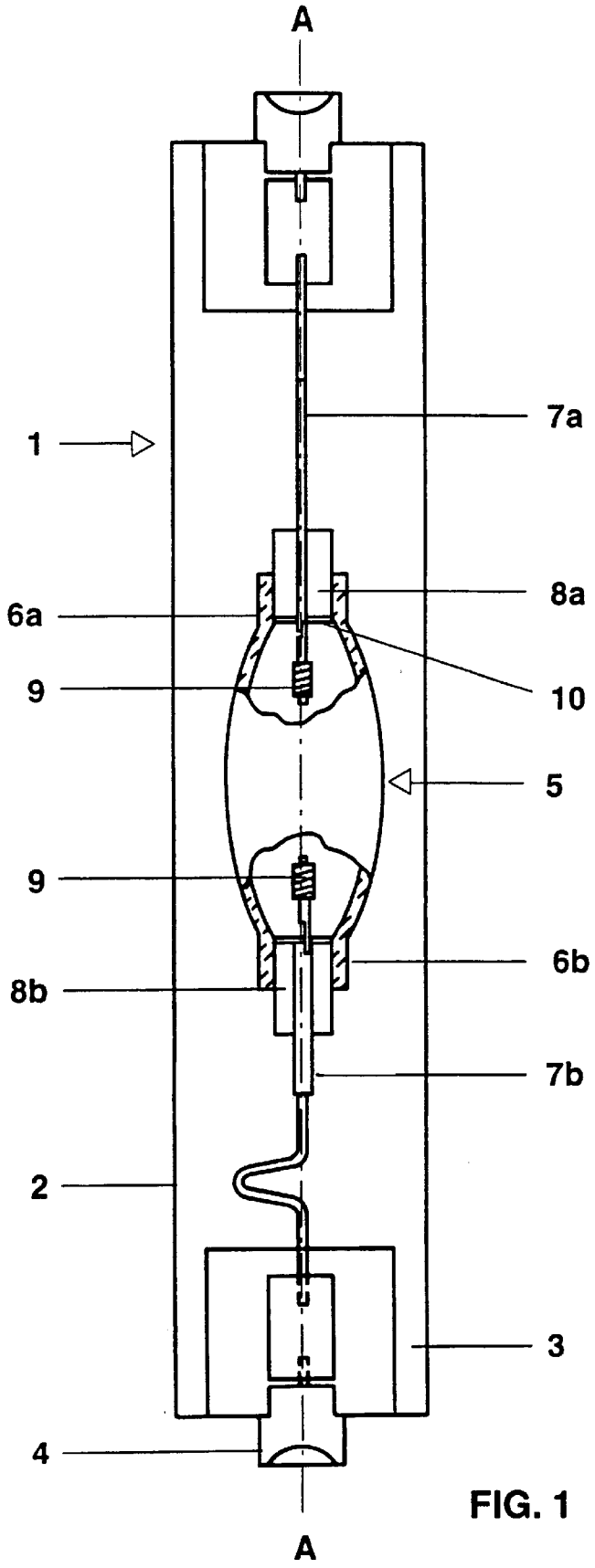
FIG. 1 is a highly schematic view of a lamp with a ceramic device, partly in section.

Referring first to FIG. 1 which, for purpose of illustration, shows in highly schematic form a metal halide discharge lamp 1 with a power rating of 150 W. The lamp has an essentially cylindrical outer envelope 2 made of quartz glass, which is pinch sealed at its ends 3 and supplied with bases 4. A ceramic envelope device 5 acts as a discharge vessel or arc tube that is enclosed within the outer bulb 2. The ceramic arc tube device 5 defines a central longitudinal axis A having two ends and is made from alumina. It is formed, for example, as a cylindrical tube (not shown) or it may be bulged outwardly in the center, as shown. It is formed with cylindrical end portions 6*a* and 6*b* at the two ends. Two current feedthroughs 7*a*, 7*b* are fitted, each, in a ceramic-like (cermet) end plug 8*a*, 8*b*, located in the end portions 6*a* and 6*b*.

The first current feedthrough 7*a* is a molybdenum pin which is directly sintered into the first end plug 8*a* located in the first end portion 6*a*. The plug is a one part ceramic-like body consisting of composite material (alumina and tungsten) as already known for example from EP-A 609 477.

The second current feedthrough 7*b* is a molybdenum tube which is directly sintered into the second end plug 8*b* located in the second end portion 6*b* and being a multipart plug. Electrodes 9 are located at the inner tip of the feedthroughs 7*a*, 7*b*.

It is advantageous to apply an insulating coating 10 such as pure alumina to the inside surface of the cermet end plugs 8*a* and 8*b* so as to prevent arcing between the plasma column of the arc discharge and the cermet plugs 8*a* and 8*b*, that can cause darkening and leakage.

The arc tube 5 encloses a fill which includes an inert ignition gas, for example argon, as well as mercury and additives of metal halides, for example rare earth iodides.

During manufacture of the lamp the second, tubular feedthrough 7*b* acts as a pump and fill opening used to evacuate and then to fill the arc tube 5. This technique is well known (see citations above). It is only then that the feedthrough 7*b* is closed.

Figure 2:
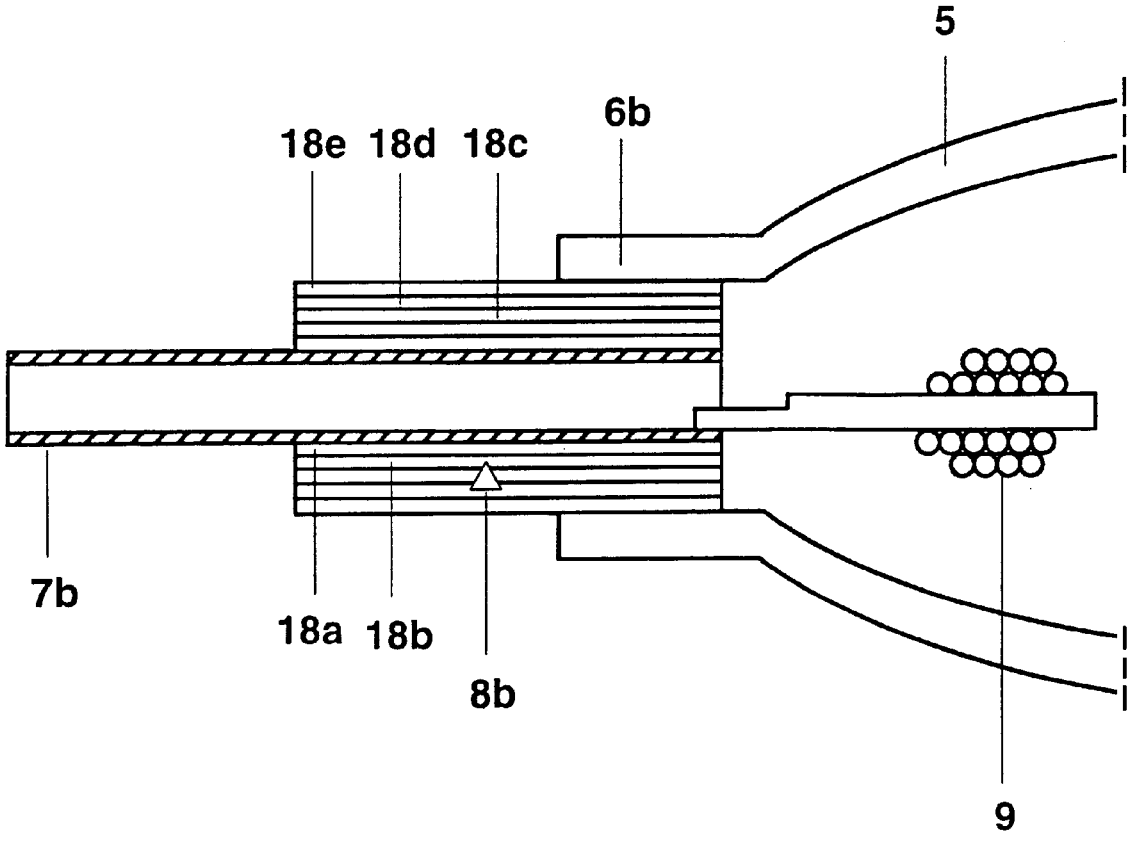
FIG. 2 is a detailed view on the first end of the arc tube, showing a first embodiment of the invention.

FIG. 2 is a detailed view on the second end of the arc tube 5. It illustrates that the plug 8*b* is a multipart plug made from five concentric rings 18*a*–18*e*. Each ring 18*a*–18*e* is made from a non-conductive cermet consisting of a mixture of alumina and tungsten. The tungsten concentration increases from the innermost ring-like zone 18*a* to the outermost ring-like zone 18*e*. The outermost ring-like zone 18*e* is directly sintered to the end portion 6*b* of the arc tube 5, the innermost ring-like zone 18*a* is directly sintered to the feedthrough 7*b*. Innermost zone 18*a* is made from alumina with a proportion of tungsten of 40 vol.-%. The adjacent first intermediate zone 18*b* is made from 32 vol.-% tungsten, balance alumina. The composition of the further zones follows the principles outlined above. The proportion of tungsten (W) decreases towards the outermost zone. Zone 18*c* has 25% tungsten, zone 18*d* has 15% tungsten. Outermost ring zone or layer 18*e* is made from pure alumina.

Generally speaking, in case of five ring zones or ring layers the preferred typical ranges for the composition of the zones are as follows:

innermost ring zone 18*a*: 38 to 43% W, balance alumina;

first intermediate layer 18*b*: 30 to 37% W, balance alumina;

second intermediate layer 18*c*: 20 to 30% W, balance alumina;

third intermediate layer 18*d*: 5 to 20% W, balance alumina;

outermost ring zone 18*e*: 100% alumina.

The thermal behavior of the innermost ring zone 18a matches that of the molybdenum tube 7*b* which acts as feedthrough. The material of ring zone 18*e* is quite the same as that of the arc tube (let beside specific dopants) and is directly sintered to the arc tube end portion 6*b*.

Figure 3:
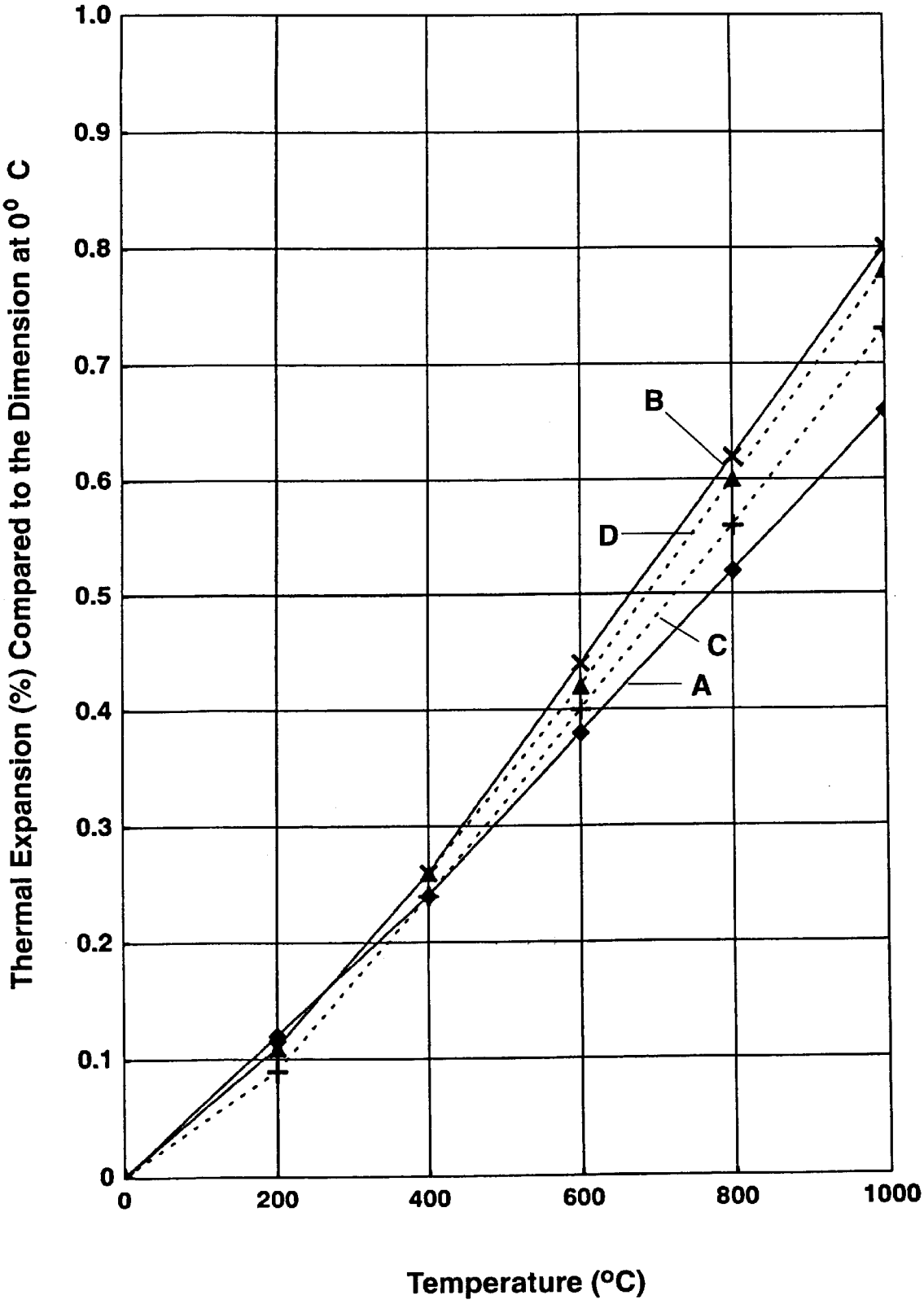
FIG. 3 is a diagram showing expansion versus temperature for different cermet parts.

FIG. 3 shows the absolute degree of thermal expansion (in percent compared to 0° C.) versus temperature of the tubular feedthrough 7*b* (molybdenum, curve A), of the outermost ring zone 18*e* (pure alumina; curve B), and of examples for two intermediate layers (alumina with 30% tungsten, curve C; and alumina with 20% tungsten; curve D). It is a special trick to use a cermet comprising tungsten as the metal component in combination with a feedthrough made from molybdenum. Tungsten has a markedly lower coefficient of thermal expansion than molybdenum. Hence accommodation of the desired features of the ring zones is easier by adding tungsten to the alumina since in comparison to molybdenum smaller amounts of tungsten are sufficient to reach the desired thermal coefficient of a special zone.

Figure 4:
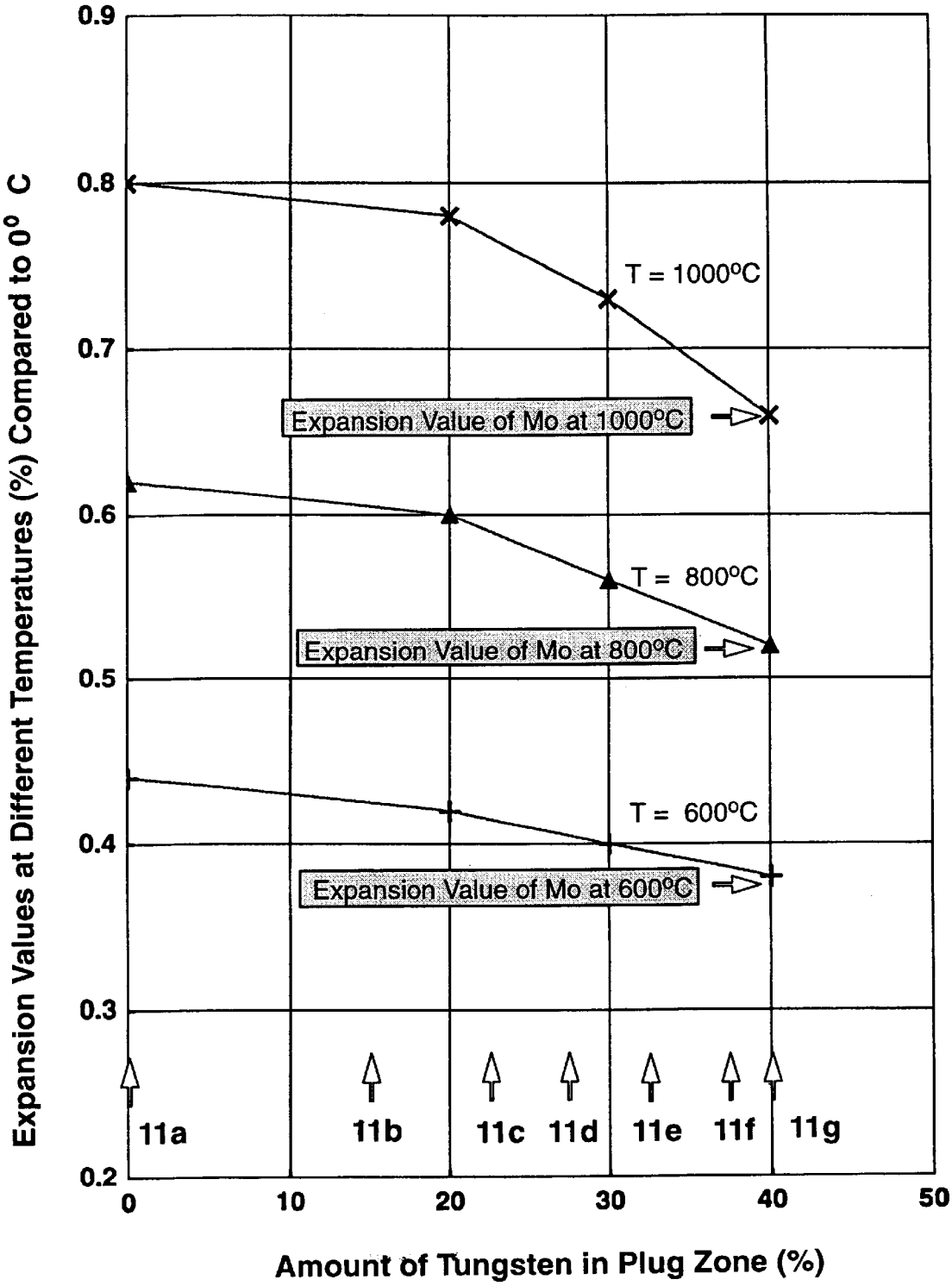
FIG. 4 is a diagram showing expansion values at different temperatures for different proportions of tungsten in the cermet part.

FIG. 4 illustrates the absolute degree of thermal expansion (in percent compared to 0° C.) at different temperatures T versus tungsten proportion for different cermet end plug zones. It shows that an about 40% tungsten proportion (balance alumina) has similar thermal features like a pure molybdenum feedthrough (arrows) under high temperatures. The difference in absolute expansion between adjacent ring-like zones is very small. The five zones 18*a*–18*e* are indicated by arrows.

Figure 5:
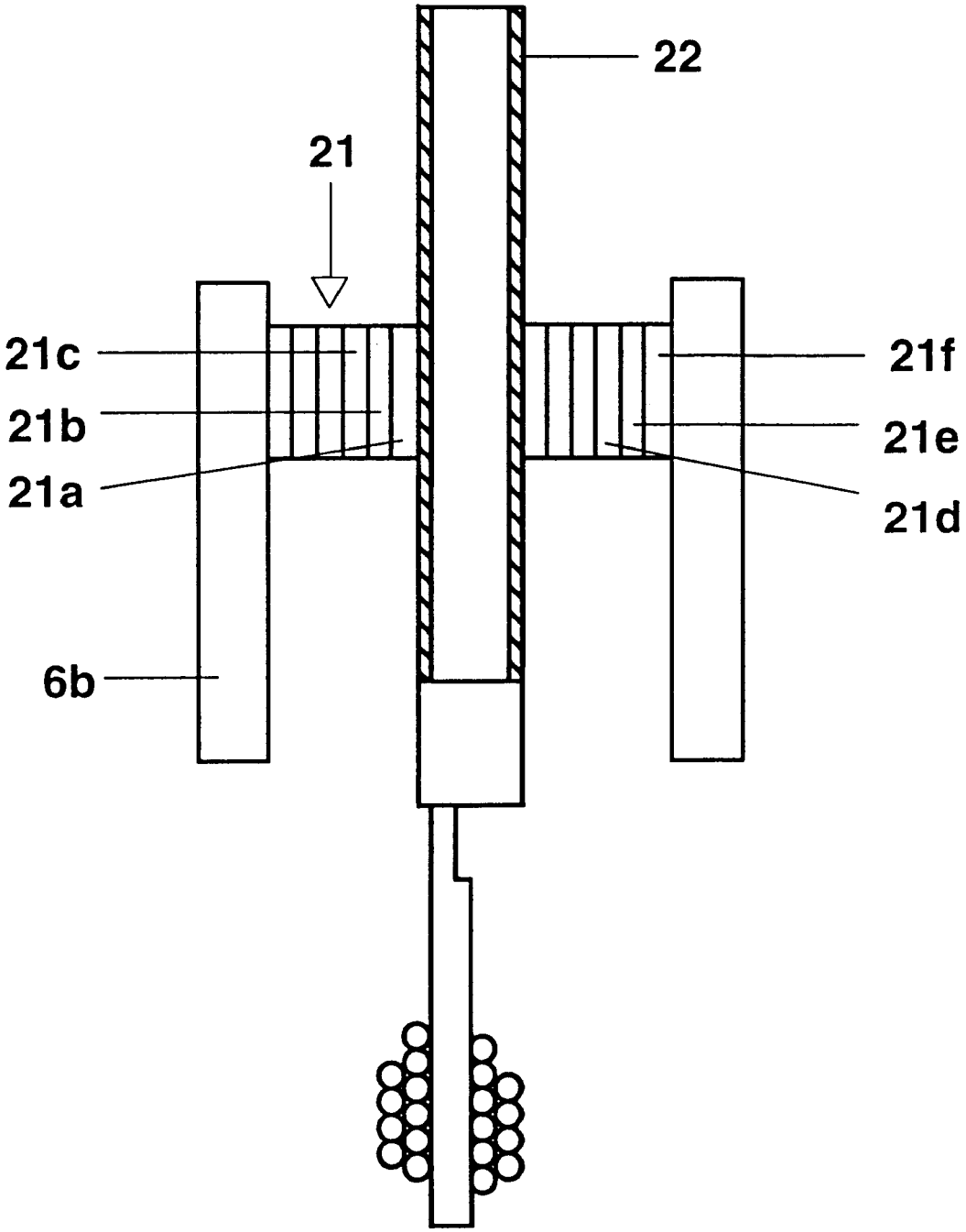
FIG. 5 is a detailed view on the first end of the arc tube, showing a second embodiment of the invention.

FIG. 5 shows another embodiment of a radially graded seal. It uses an aluminatungsten cermet end-enclosure-member or end plug 21 made from a tape which is directly bonded to the PCA end portion 6*b* at its outer surface and to a tubular feed-through 22, made from a molybdenum hollow rod, at its inner surface. The cermet end plug 21 consists of six zones or layers radially stacked with the metal concentration increasing from a low level in the outermost layer 21*f* to a high level in the innermost layer 21*a*. The design in FIG. 5 has the following tungsten weight percentages in the six layers from the inside to the outside as:

outermost ring zone 21*fa*: 25 wt.-% tungsten, balance alumina;

first intermediate layer 21*e*: 45 wt.-% W, balance alumina;

second intermediate layer 21*d*: 60% W, balance alumina;

third intermediate layer 21*c* 75 wt.-% W, balance alumina;

fourth intermediate layer 21*b*: 84 wt.-% W, balance alumina;

innermost ring zone 21*a*: 92 wt.-% W, balance alumina.

These wt.-% values correspond to volume percentages of 6, 15, 24, 38, 52, and 70 vol.-% of W, which correspond to thermal expansion coefficients of 7.5, 7.0, 6.5, 6.0, 5.5, $5.0\times10^{-6}/°$ C.

Such design effectively produces a smooth gradient in thermal expansion of the cermet thus bridging PCA arc tube and metal feedthrough. This is required in order to minimize thermal stresses incurred during the cooldown portion of the fabrication cycle of the plug-feedthrough assemblies, as well as during lamp on-and-off operation cycles.

In a further embodiment (FIG. 6) a "top hat" -type configuration is used for the outermost ring zone 25*f* of a multipart plug 25 consisting of six layers. At first, the cermet end plug 25 and the tubular feedthrough 22 are prefired together and thus an assembly is created. It is then mounted on the open end 6*b* of the arc tube (prefired or already sintered to translucency), and the entire assembly is brought up to high temperatures to form an interference bond between the innermost ring layer 25*a* and the metal feedthrough 22 (tungsten or molybdenum ), and between the outermost ring layer 25*f* and the end portion 6*b* of the PCA tube, simultaneously.

It is advantageous to apply an insulating coating 26 such as pure alumina to the inside surface of the cermet end closure 25 so as to prevent arcing between the plasma column of the arc discharge and the cermet plug 25, that can cause darkening and leakage.

The radially graded cermet end plug can be made by several techniques including tape casting, pressing, and spraying.

In the case of tape casting, a non-aqueous slurry is first made, consisting of alumina and metal (W/Mo) powders dispersed in a liquid medium such as methyl ethyl ketone and isopropanol along with binders such as polyvinyl butryal. The slurry is ballmilled to produce a homogeneous mixture, which can be formed into thin tapes using the doctor-blade process practiced widely in multi-layer ceramic substrate packaging production in the electronics and computer industry. Tapes as thin as 0.001 to 0.045 inch can be produced. Considering the ability of being handled, a thickness of 0.25 mm (0.010") is thought to be reasonable. The tapes in the green state are typically flexible such that they can be wound around a slightly oversized plastic mandrel (larger diameter than the W/Mo feedthrough) to form the first layer. Successive layers in the cermet can be applied from green tapes containing gradually decreased metal contents. The multi-layered-tape green structure can then be pressed slightly in the radial direction, and dried and prefired at relatively low temperatures (1000–1500° C.) in vacuum, hydrogen, or argon to remove the binder and mandrel. During the prefiring, the inner diameter of the cermet may shrink 0–10% depending on the prefiring temperature. It is important to select the starting alumina and metal powders of appropriate particle sizes, and the solid loadings in the slurry, so that the multi-layers shrink essentially in unison.

Figure 7A:
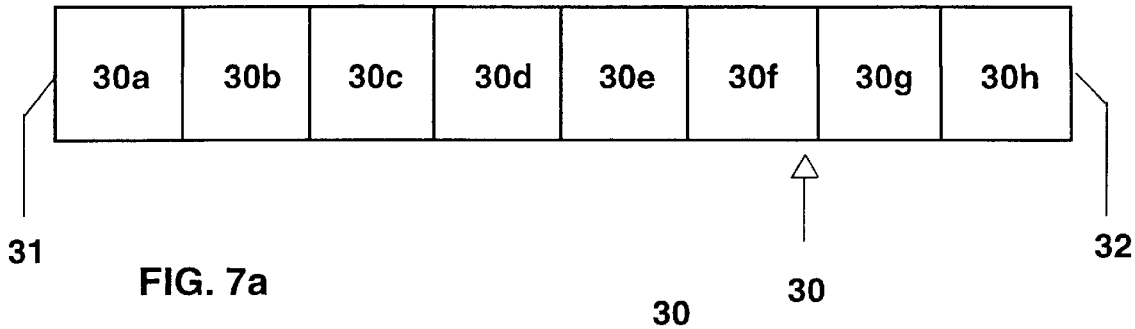
FIGS. 7*a*–7*c* are a scheme of the manufacturing steps for a radially graded cermet by using the tape casting technology.

In FIG. 7, a tape casting technique for manufacturing radially graded cermets is shown.

In a first step (FIG. 7*a*), a tape 30 made from alumina is prepared, which consists of different sections 30*a*–*h* each one having a little bit lower tungsten amount than the one before. The left end 31 is the alumina matching side (low tungsten content), the right end 32 is the feedthrough matching side (high tungsten content).

In another embodiment the tape comprises a continuous gradient of tungsten concentration from the first end 31 to the second end 32.

Typical tungsten concentrations are already outlined above.

Figure 7B:
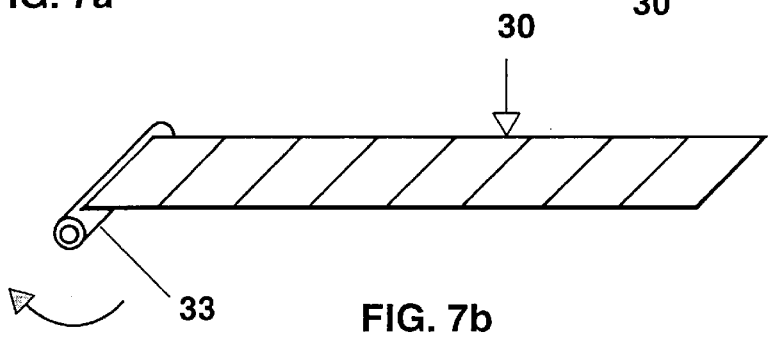

In FIG. 7*b* the tape 30 being still in its green state and therefore being plastically deformable is wound around the molybdenum tubular feedthrough 33. The winding starts with the high tungsten concentration end 31. The length of the different sections is adapted to the diameter and circumference of the tube. Preferably the length of each section increases from the left end (high content) to the right end.

Figure 7C:
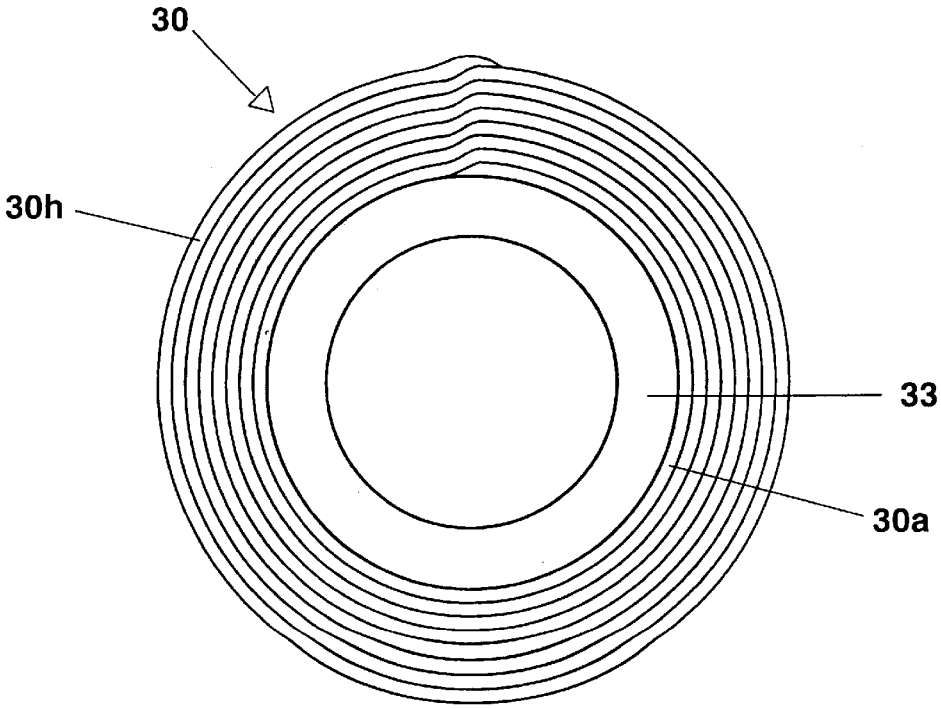

FIG. 7*c* shows a top view onto an accomplished feedthrough/plug assembly illustrating the increasing circumference due to the winding.

Pressing can form the radially multi-layer structure. Alumina-metal (Mo/W) powder mixture can be made by ball-milling an aqueous suspension of alumina and metal powders along with organic binders such as polyvinyl alcohol and/or polyethylene glycol. Metal precursors such as ammonium tungstate can be dissolved in water added with alumina powder. The ball-milled slurry can be pan-dried or spray-dried. If metal precursor is used, the mixture requires pyrolysis at high temperatures (e.g. 1000° C.) to form metal particles. If metal powder is used, the dried mixture can be added to a die having a large core rod, and pressed to form the outermost layer. The core rod is then removed and replaced with a smaller core rod. The powder mixture designed for the next layer is added to the cavity between the core rod and the pressed, outermost layer. Pressure is applied so as to form the second layer. Repeating of the above operation with successive powder mixtures and core rods results in a final green body consisting of multiple layers packed in the radial direction. The green structure can then be ejected, and prefired at relatively low temperatures (1000–1500° C. in vacuum, hydrogen, or argon to remove the binder. During the prefiring, the inner diameter of the cermet may shrink 0–10% depending on the prefiring temperature. It is important to select the starting alumina and metal powders of appropriate particle sizes, and the solid loadings in the slurry, so that the multi-layers shrink uniformly.

Spraying is another method to form the radially multilayer structure. Alumina-metal (Mo/W) powder mixture can be made by ball-milling an aqueous suspension of alumina and metal powders along with organic binders such as polyvinyl alcohol, polyethylene glycol, or polyox. Metal precursors such as ammonium tungstate can be dissolved in water added with alumina powder. The ball-milled slurry can be sprayed onto a rotating, porous, slightly oversized, polymeric mandrel that is heated. Spraying can be accomplished using a two-jet, ultrasonic, or electrostatic atomizer. The binder content and solids loading of the slurry are selected such that the aqueous mixture sticks to and deposits on the W or Mo tube, much like spraying of phosphors slurry onto the inside of a fluorescent lamp's glass tube. Heating the mandrel slightly during the spraying process may be beneficial to a stronger adhesion of the powder mixture to the metal and cohesion of the powder mixture itself. Spraying and deposition of successive layers is conducted with slurries of decreasing metal content so as to form a radial gradient. The thickness of the layers can be as thin as 0.01 mm, see "Recent Development of Functionally Gradient Materials for Special Application to Space Plane", R. Watanabe and A. Kawasaki, pp. 197–208, Composite Materials, ed. A. T. Di Benedetto, L. Nicolais, and R. Watanabe, Elsevier Science, 1992.

The green body can be cold isostatically pressed, and then prefired at relatively low temperatures in hydrogen, nitrogen-hydrogen, or vacuum to bum-out the mandrel and remove the binders to produce a radially graded cermet. During the prefiring, the inner diameter of the cermet may shrink 0–10% depending on the prefired temperature. It is important to select the starting alumina and metal powders of appropriate particle sizes, the solids loadings in the slurry, and the pressure of the cold isostatical pressing step, so that the multi-layers shrink coherently.

The W/Mo tube is then placed in the center hole of the prefired, radially graded cermet. The whole assembly is heated to high temperatures (1800 to 2000° C.) in hydrogen or nitrogen-hydrogen to (1) cause the cermet to sinter, and (2) form the interference bond between the metal feedthrough and cermet. The degree of interference is typically 4–10%, depending on the dimensional shrinkage during sintering and the clearance between the inner diameter of the prefired cermet and the outer diameter of the metal feedthrough. The sintered cermet-feedthrough assembly can be optionally HIPed at high temperatures to further decrease residual pores.

The sintered cermet-feedthrough assembly is placed inside a prefired PCA straight tube or inside the straight portion of a prefired elliptically-shaped PCA bulb. The PCA consists of alumina, preferably doped with MgO, or MgO plus zirconia. The entire assembly is sintered in hydrogen or nitrogen-hydrogen to densify PCA to translucency. During sintering, the PCA shrinks against the outer diameter of the cermet to form an interference bond. The degree of the interference in the direct bond depends on the shrinkage of the PCA and the clearance between the cermet and the inner diameter of the prefired PCA. Both ends of the prefired PCA should have the sintered cermet-feedthrough so that, upon sintering of the PCA, the spacing between the electrode tips is shrunk to a specified cavity length for the lamp. If the feed-through of the sintered end structure located an one end of the PCA is a rod, the PCA sintering step produces an one-end-closed envelope containing hermetically sealed feedthroughs ready for dosing.

It is possible to simultaneously accomplish the interference bonds between the innermost layer and W/Mo tube, and the outermost layer and PCA, in a one-step sintering in which the prefired graded cermet consolidates to nearly full density, and PCA sinters to translucency.

Lamp fills including various metal halides, mercury, and fill gases can then be added to the envelope through the Mo/W tubular feedthrough at one end of the feedthrough-cermet enclosure. Mo/W tubes can finally be sealed using a laser (Nd-YAG or $CO_2$) welding technique so as to accomplish the entire arc envelope made of PCA (enclosed by graded cermets) equipped with halide-resistant Mo/W feedthroughs, FIG. 1. This technique is well-known.

Figure 6:
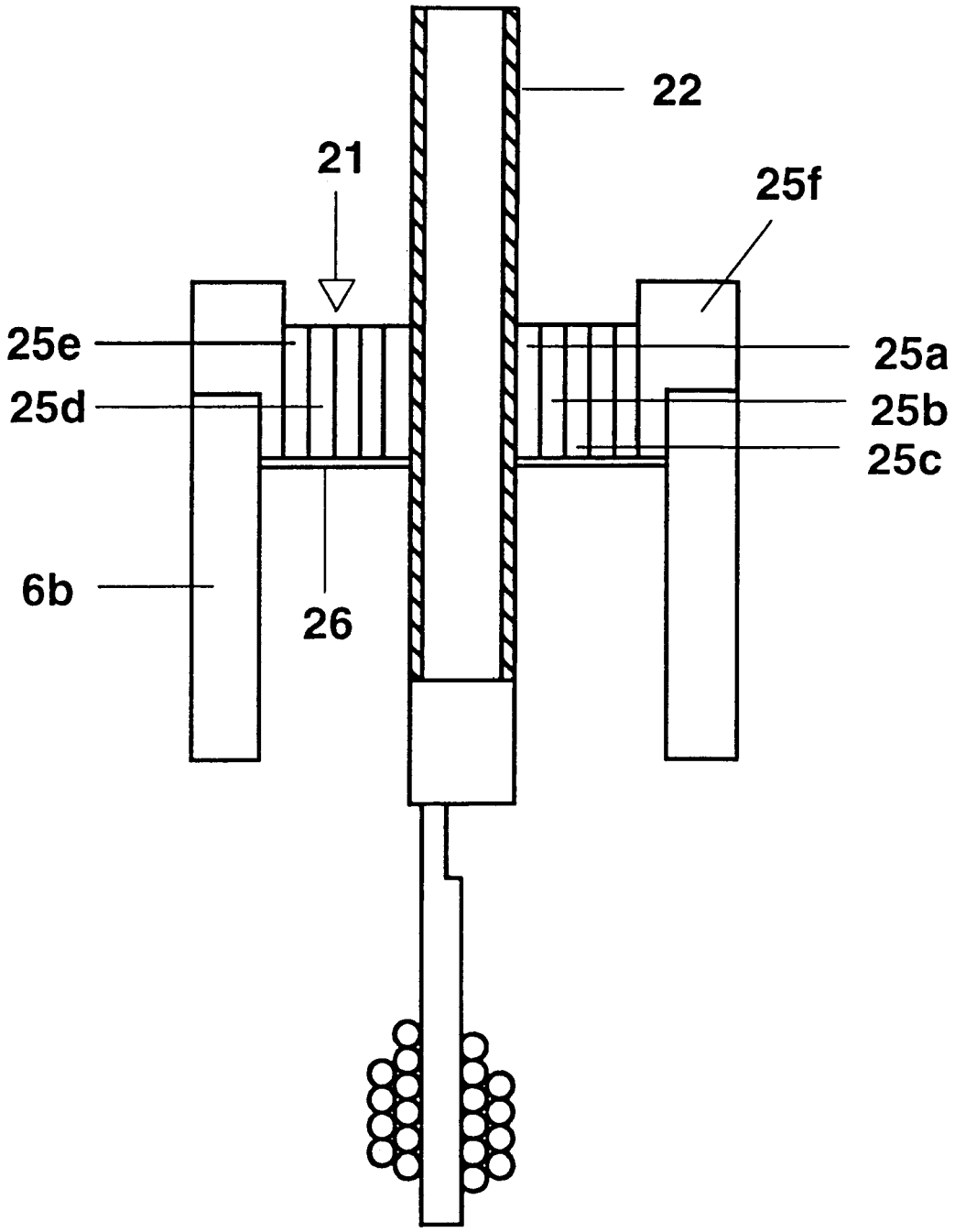
FIG. 6 is a detailed view on the first end of the arc tube, showing a third embodiment of the invention.

Alternatively, FIG. 2, 5 or 6 represent a different structure of the end plug. In this further embodiment, the feedthrough 7*b*, and 22 resp., is made from molybdenum. The innermost layer 18*a*, 21*a*, and 25*a* respectively, is made from an AlN layer (with a coefficient of thermal expansion of $5.7\times10^{-6}$/° C., close to that of molybdenum, $5.0\times10^{-6}$/° C.) which is adjacent to the molybdenum feedthrough 7*b*, and 22 resp. The outermost layer and the intermediate or transitional layers 18*b*–18*e*, 21*b*–21*f*, and 25*b*–25*f* respectively, between the AlN layer 18*a*, 21*a* and 25*a* and the end portion 6*b* of the PCA tube are made from aluminum oxynitride with various proportions of alumina with respect to aluminum nitride. The thermal expansion of aluminum oxynitride depends on the nitrogen content, and is reported as $7.8\times10^{-6}$/° C. for $5AlN\cdot9Al_2O_3$.

An even more promising embodiment results from the fact, that AlN is known to be compatible with molybdenum, and AlN-Mo cermet is reported ("Thermomechanical Properties of SiC-AlN-Mo Functionally Gradient Composites", M. Tanaka, A. Kawasaki, and R. Watanabe, Funtai Oyobi Funmatsu Yakin, Vol. 39 No. 4, 309–313, 1992). Accordingly, the innermost layer in contact with the feedthrough is made from an AlN-Mo cermet instead of pure AlN. The first intermediate layer adjacent to the innermost layer is made from pure AlN or from a cermet with different proportion between AlN and molybdenum.

In a further embodiment the cermet zones consist of alumina and non-metal components such as metal carbides and metal borides. Examples of such components are tungsten carbide and tungsten boride, see U.S. Pat. No. 4,825,126, Izumiya et al.

In a further embodiment the plug is subdivided into even more parts, zones or layers. Thus, the difference in thermal expansion behavior between adjacent parts becomes even smaller. The number of parts can be increased to ten, twelve, or even more layers.

The process starts with preparation of the powder mixtures for each of the layers. For example, tungsten precursors such as ammonium tungstate or molybdate can be dissolved in water and mixed with alumina powder (e.g. Baikowski CR 30, 15, 6, 1 powders of various mean particle sizes) at a predetermined ratio along with binders such as polyvinyl alcohol and/or polyethylene glycol. Sintering aids such as MgO (derived from magnesium nitrate that is soluble in water) for alumina can be included. Alternatively, fine W or Mo powder [e.g. type M-10 W powder with a mean particle size of 0.8 $\mu$m, or other types such as M-20 (1.3 $\mu$m), M-37 (3 $\mu$m) M-55 (5.2 $\mu$m), and M-65 (12 $\mu$m) from OSRAM SYLVANIA at Towanda, PA.] can be mixed with alumina powder dispersed in water, and ball-milled (with e.g. alumina balls) to produce a uniform mixture. The resultant mixture can be spray-dried or pandried. The dried mixture is deagglomerated using a mill such as a vibrational mill to break down the soft agglomerates. In the case of metal precursors, the mixture is heated to a temperature (e.g. 1000° C. in hydrogen, or vacuum, or inert gas) where the precursor decomposes into metal particles.

The mixture powder is then loaded into a die with a core rod (designed to fit the diameter of the W or Mo tube or rod), and compacted (e.g. at 12 ksi) to a given green density. Powders for successive layers are prepared and added to the die one at a time, and then again compacted, until the final layer containing a high level of W is added. The entire assembly is compacted at 10 to 35 ksi, and ejected from the die. (The core rod could be designed to be stepped for the layers, such that the dimensional shrinkage of all the layers are compatible with the downstream processes for the formation of the top layer-Mo tube direct-bond as well as the formation of the bottom layer-PCA tube direct-bond.) The hollow-cylinder green body is then prefired at relatively low temperatures in hydrogen or vacuum or insert gas to remove the binders with essentially no dimensional shrinkage, and impart some strength for handling.

The W or Mo tube (or rod) is inserted in the hole of the prefired, multi-layer, hollow, cylindrical cermet. The assembly is prefired (1200–1500° C.), or prefired and sintered, in hydrogen, at relatively high temperatures (e.g. 1800–2000° C.) to produce a predetermined interference bond (e.g. 4 to 18%) between the innermost layer (which has a high level of W or Mo) and the metal feedthrough. During the firing, the innermost layer is shrunk against the W/Mo tube so as to form a fritless, hermetic seal. It is important to design the dimensional shrinkage (through optimization of the particle sizes of the metal and alumina phases, and the compaction pressure) of all the layers with respect to the clearance between the W/Mo part and the green or prefired multilayered cermet, so that the formation of the interference bond between the top layer and W/Mo tube is not obstructed by other layers.

The prefired and sintered cermet-feedthrough assembly can be optionally HIPed (hotisostatically-pressed) at high temperatures (e.g. 1800° C.) to produce fully dense bodies. The sintered or HIPed W/Mo feedthrough-graded cermet plug member is then placed inside a prefired PCA tube, or inside the shank portion of a prefired, elliptically-shaped PCA tube. The PCA can be made by prefiring (1000–1500° C.) a green body of alumina powder doped with sintering aids such as MgO, MgO plus zirconia, or MgO plus erbium oxide. Both ends of the prefired PCA envelope have the densified feedthrough-graded cermet bodies placed at a predetermined distance.

During sintering of the entire assembly in hydrogen or nitrogen-hydrogen at 1800–2000° C., the PCA tube densifies to translucency and dimensionally-shrinks to accomplish (1) an interference bond between the bottom layer (has a low level of metal phase) and the PCA tube, and (2) a specified cavity length between the tips of the opposing electrodes. If, at the first end of the PCA, the W/Mo feedthrough is a rod, this sintering process produces a one-end-closed envelope ready for dosing. The degree of the interference for the direct bond between the outermost layer of the cermet and the alumina (PCA) arc tube during co-firing is determined by the clearance between them, prefiring temperature used, and sintering shrinkage.

Lamp fills including various metal halides and fill gas can then be added to the envelope through the Mo/W tubular feedthrough at the second end of the feedthroughcermet enclosure. Mo/W tubes can finally be sealed using a laser (Nd-YAG or $CO_2$) welding technique so as to accomplish the entire arc envelope made of PCA (enclosed by a graded cermet) equipped with halide-resistant Mo/W feedthroughs.

One option is to have a top hat configuration for the outermost layer of the multipart plug. The prefired cermet-feedthrough can then be mounted on one open end of a PCA tube (prefired or already sintered to translucency), and the entire assembly is brought to high temperatures to form the shrunk-bond between the innermost layer and W/Mo, and the outermost layer and PCA, simultaneously.

It is obvious that an insulating coating such as pure alumina can be applied to the inside surface of the cermet enclosure so as to prevent arcing between the plasma column and cermet, that can cause darkening and leakage.

In order to further amend gas-tightness of such a bond a frit can be applied to the outer surface (remote from the discharge) of the innermost layer.

The hermeticity of the metal-cermet-bond is presumably based on the formation of a solid-solution layer or a mixed solid phase-liquid phase layer.

An essentially preferred PCA arc tube of high stability is made of alumina doped with 100 to 800 ppm MgO and 100 to 500 ppm $Y_2O_3$, preferably with 500 ppm MgO and 350 ppm $Y_2O_3$. Preferably, the grain size of such a ceramic is as small as possible to improve mechanical strength.

In a further embodiment the feedthrough is a two part body consisting of an outer tube and a solid rod inside.

Preferably, the tubular feedthrough is either flush or even recessed with the inside surface (facing the discharge) of the plug.

It is advantageous to shorten the length of the bond between the outermost/bottom layer and the PCA arc tube as good as possible. A good estimate is to chose a length of the bond interface which is as small as the wall thickness of the PCA arc tube.

Of course the principles of this invention can be directed to another scenario using another ceramic type (for example AlN or $Y_2O_3$) together with other cermet materials.

Of course, instead of using the end portion of an arc tube a separate ceramic ring-like end member can be used.

While there have been shown an described what are at present considered the preferred embodiments of the invention, it will be apparent to those skilled in the art that various changes and modifications can be made herein without departing from the scope of the invention as defined by the appended claims.

What is claimed is:

1. A ceramic envelope device for a high pressure discharge lamp containing a metal halide fill comprising:

a translucent ceramic tube having a first end and a second end, the tube confining a discharge volume and defining a longitudinal axis;

a first electrically non-conducting cermet end plug, said first plug closing said first end of the ceramic tube;

a second electrically non-conducting cermet end plug, said second plug closing said second end of the ceramic tube;

at least said second plug having a multipart structure with at least three parts;

a first and second metal feedthrough passing through the first and second plug respectively, each feedthrough having a inner and outer end, respectively, and at least said second feedthrough being a tube made from one of the group of the metals tungsten, molybdenum and rhenium and alloys from at least two of these metals;

two electrodes located at the inner end of the first and second feedthrough respectively;

the coefficient of thermal expansion of at least one part of the multipart plug being between those of the arc tube and the feedthrough;

wherein said multipart plug comprises at least four radially aligned concentric parts with different coefficients of thermal expansion, including a first and a last part, the first part being innermost with respect to the second feedthrough and the last part being outermost with respect to the feedthrough;

the difference between the coefficients of thermal expansion for adjacent parts including the arc tube and the related feedthrough being less than $1.0\times10^{-6}$/K;

the multipart plug is directly sintered both to the arc tube and the feedthrough in that manner that the first part of the multipart plug is directly sintered to the related feedthrough and the last part of the multipart plug is directly sintered to the arc tube.

2. A ceramic envelope device according to claim 1, wherein the composition of the different parts differs in the proportion of the metal.

3. A ceramic envelope device according to claim 1, wherein the composition of the different parts comprises aluminum nitride and aluminum oxynitride.

4. A ceramic envelope device according to claim 1, wherein said multipart plug is a cylindrically shaped structure with a central bore, only the innermost, first layer adjacent the feedthrough being in gas tight contact with the feedthrough.

5. A ceramic envelope device according to claim 1, wherein the multipart plug consists of at least five concentric ring zones.

6. A ceramic envelope device according to claim 1, wherein the last, outermost part of the multipart plug has a "top hat" structure.

7. A ceramic envelope device according to claim 1, wherein only the second feedthrough is tubular.

8. A ceramic envelope device according to claim 1, wherein the first feedthrough is a pin or rod.

9. A ceramic envelope device according to claim 1, wherein the first, innermost part of the second plug has an amount of metal of at least 50 vol.-% and is weldable.

10. A ceramic envelope device according to claim 1, wherein the ceramic material of the arc tube consists of alumina doped with further materials, preferably magnesia and yttria.

11. A ceramic envelope device according to claim 10, wherein a separate filling hole or bore is located in the second plug.

12. A ceramic envelope device according to claim 1, wherein said first plug is a one-part body.

13. A ceramic envelope device according to claim 1, wherein said first plug is a multipart body similar to said multipart plug.

14. A ceramic envelope device according to claim 1, wherein said plug is disc-like made from concentric parts with radially graded coefficients of thermal expansion.

15. A ceramic envelope device according to claim 1, wherein the coefficient of thermal expansion changes smoothly.

16. A lamp with a ceramic envelope according to claim 1.

17. A ceramic envelope device for a high pressure discharge lamp containing a metal halide fill comprising:

a translucent ceramic tube having a first end and a second end, the tube confining a discharge volume and defining a longitudinal axis;

a first electrically non-conducting cermet end plug, said first plug closing said first end of the ceramic tube;

a second electrically non-conducting cermet end plug, said second plug closing said second end of the ceramic tube;

at least said second plug having a multipart structure with at least three parts;

a first and second metal feedthrough passing through the first and second plug respectively, each feedthrough having a inner and outer end, respectively, and at least said second feedthrough being a tube made from one of the group of the metals tungsten, molybdenum and rhenium and alloys from at least two of these metals;

two electrodes located at the inner end of the first and second feedthrough respectively;

the coefficient of thermal expansion of at least one part of the multipart plug being between those of the arc tube and the feedthrough;

wherein said multipart plug comprises at least four radially aligned concentric parts with different coefficients of thermal expansion, including a first and a last part, the first part being innermost with respect to the second feedthrough and the last part being outermost with respect to the feedthrough;

the difference between the coefficients of thermal expansion for adjacent parts including the arc tube and the related feedthrough being less than $1.0\times10^{-6}$/K;

said multipart plug being spirally wound with zones of step-wise increasing coefficients of thermal expansion and being directly sintered both to the arc tube and the feedthrough in that manner that the first part of the multipart plug is directly sintered to the related feedthrough and the last part of the multipart plug is directly sintered to the arc tube.

* * * * *